US006539191B2

(12) United States Patent
Itaya

(10) Patent No.: US 6,539,191 B2
(45) Date of Patent: Mar. 25, 2003

(54) ELECTROPHOTOGRAPHIC COLOR IMAGE FORMATION SYSTEM AND METHOD USING LIQUID DEVELOPERS

(75) Inventor: Masahiko Itaya, Akishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/983,648

(22) Filed: Oct. 25, 2001

(65) Prior Publication Data

US 2002/0085860 A1 Jul. 4, 2002

(30) Foreign Application Priority Data

Oct. 30, 2000 (JP) ..... 2000-330895
Sep. 17, 2001 (JP) ..... 2001-281194

(51) Int. Cl.[7] ..... G03G 15/01; G03G 15/10
(52) U.S. Cl. ..... 399/237; 399/302; 430/117
(58) Field of Search ..... 399/226, 233, 399/237, 298, 302, 308; 430/117

(56) References Cited

U.S. PATENT DOCUMENTS 5,176,974 A * 1/1993 Till et al. ..... 430/117 X
5,612,777 A * 3/1997 Malhotra ..... 399/226
5,915,144 A * 6/1999 Ide et al. ..... 399/298
6,397,030 B1 * 5/2002 Watanabe ..... 399/237

FOREIGN PATENT DOCUMENTS

JP 3-144668 * 6/1991
JP 4-365061 * 12/1992
JP 2000-56575 * 2/2000

* cited by examiner

*Primary Examiner*—Fred L. Braun
(74) *Attorney, Agent, or Firm*—Oblon, Spivak, McClelland, Maier & Neustadt, P.C.

(57) ABSTRACT

A method and system for forming electrophotographic images by forming on a transfer belt color toner images of, e.g., the colors of transparent, yellow, magenta, cyan and black in that order from the side of the belt. When the toner images are brought into contact under pressure with, and then transferred to, a recording medium, e.g. a copy sheet, the image on the sheet is obtained with the order of the layers reversed with the transparent toner layer as the uppermost. With the use of transparent toners having relatively large particle size to cover a plurality of underlying color toner layers formed beforehand, the efficiency in image fixing is considerably improved. In addition, by using UV curing resin as the carrier and by forming a film from the carrier itself through the curing steps by UV beam irradiation, the image fixing and surface glossiness are much improved in the electrophotographic color image formation.

24 Claims, 5 Drawing Sheets

ELECTROPHOTOGRAPHIC COLOR IMAGE FORMATION SYSTEM AND METHOD USING LIQUID DEVELOPERS

BACKGROUND OF THE INVENTION

1. Field of the Invention

This patent specification relates generally to a method for forming electrophotographic images, and more specifically to the method for forming color toner images on a photosensitive member using a plurality of liquid developers.

2. Discussion of the Background

In the liquid development process for forming electrophotographic color images, toner particles in liquid developers are designed in general to have a ratio of pigment to resin fewer than that of dry developers. With these particles undue pile height of toner layers can be alleviated and the image quality is improved. In addition, the particle size is relatively small and adhesion between the particles is generally weak.

As a result, in the process of image fixing by means of heated rolls and plates the rocking mechanism of the toner onto copy sheets is therefore less operative, thereby leading to relatively poor image fixing characteristics.

Further, although the use of non-volatile silicone oil is examined as a carrier from the safety and environmental concern, a considerable decrease in fixing efficiency has been found possibly caused by the releasing characteristics of the silicone oil.

SUMMARY OF THE INVENTION

Accordingly, it is an object of the present disclosure to provide a novel and improved liquid development method and system for forming electrophotographic color images, having most, if not all, of the advantages and features of similar employed methods, while eliminating many of their disadvantages.

It is another object of the present disclosure to provide a novel method and system for forming electrophotographic color images capable of achieving sufficient image fixing efficiency, while retaining uniformity in color images by forming a layer of transparent toner on top of a plurality of underlying color toner layers formed beforehand. In addition, sufficient image fixing capability and appropriate glossiness can be achieved with the present method and system even with the use of silicone oil as a carrier, which has high releasing characteristics.

The following brief description is a synopsis of only selected features and attributes of the present disclosure. A more complete description thereof is found below in the section entitled "Description of the Preferred Embodiments".

A method is disclosed herein for forming electrophotographic images by way of forming toner images on a photosensitive member using a plurality of liquid developers containing color particles, and subsequently transferring the toner images to a recording medium, e.g. a sheet of paper. This method includes the step of affixing transparent toner particle containing developer at least onto the portions of the toner images on the photosensitive member prior to transferring the toner images. A system implementing that method is also disclosed.

The transparent toner used can have a particle size larger than that of the color particles, and the content of solid materials in the transparent toner containing developer can be larger than that in the color particle containing developer.

In another aspect, a method and system disclosed herein is for forming electrophotographic images by forming toner images on a photosensitive member using a plurality of color particle containing liquid developers, and subsequently transferring the toner images to a recording medium, e.g. a sheet of paper, in which the color particles are charged to a first polarity.

The present method includes the step of affixing, in addition to the plurality of color particle containing liquid developers, transparent toner particle containing developers at least onto the portions of the toner images on the photosensitive member prior to transferring the toner images. The transparent toner particles in the developer are charged to a second polarity that is either the same as, or opposite to, the first polarity. A system implementing that method is also disclosed.

The transparent toner used in this method can be formed such that the content of solid materials in the developer is generally larger than that in the color particle containing developer. In addition, the developer can consist essentially of carriers which contain ultraviolet curing resin to be image fixed through ultraviolet beam irradiation, and non-contact heating steps of the toner images are preferably carried out prior to the image fixing through ultraviolet beam irradiation.

Further, the liquid developers can consist as the carrier essentially of silicone oil composition which is nonvolatile at room temperature.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the detailed description which follows, specific embodiments on liquid developers and a liquid development method for forming toner images on an image bearing member using such developers are described. It is understood, however, that the present disclosure is not limited to these embodiments, and it is appreciated that the compositions of the developers and the method disclosed herein may also be adaptable in principle to any form of electrophotographic processes. Other embodiments will be apparent to those skilled in the art upon reading the following description.

Several liquid developers and liquid development process using such developers disclosed herein will be detailed in reference to the drawings.

FIGS. 1 through 5 are prepared to illustrate the method of color image formation according to one embodiment disclosed herein, in which the tandem type process steps are adopted. In the tandem type process, in general, developers of four colors are used including black, magenta, cyan and yellow.

Figure 1:
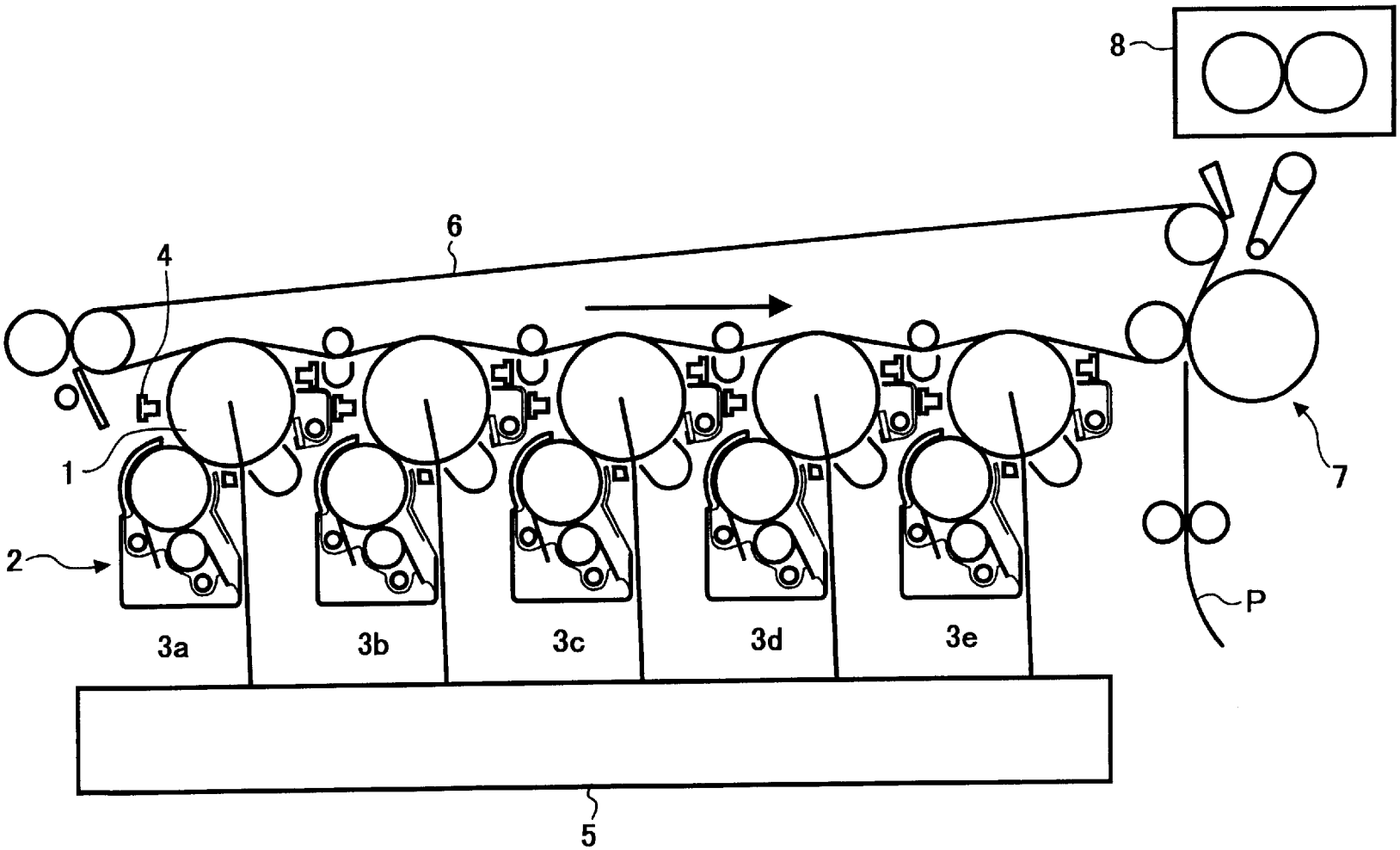
FIG. 1 is a section view of the color image forming system adapted to the tandem type process steps according to one embodiment disclosed herein.
Figure 2:
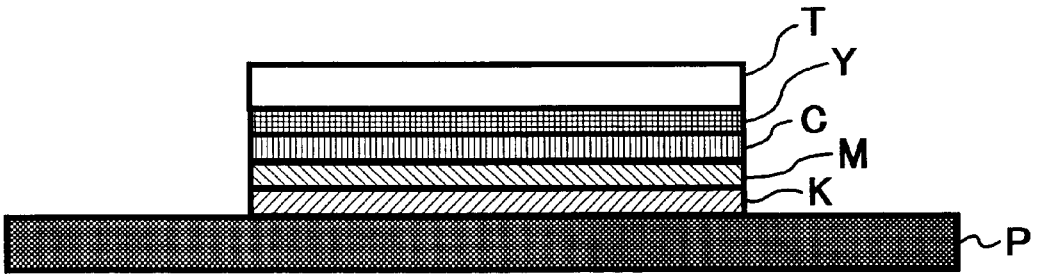
FIG. 2 is a section view illustrating the layers of transparent and color toners transferred to a copy sheet according to one embodiment disclosed herein.

Referring to FIG. 1, each of developing units 2 containing respective color developers is combined with a photosensitive member or belt 1 to form an image forming unit 3. The plurality of the image forming units 3*a*, 3*b*, . . . 3*e* are then arranged in series to form the tandem type image forming system. Also incorporated into the unit 3 are a charging unit 4 and exposure unit 5, for which the present embodiment may be adopted in addition to previously known construction thereof.

In the image forming system, process steps for forming electrophotographic images are carried out in a similar manner to those previously known including electrostatic charging, light illumination and image developing.

Toner images formed on the photosensitive member 1 are transferred to a transfer belt 6, first from the image forming unit 3*a*. After images from other image forming units 3*b* through 3*e* are successively transferred similarly onto the belt 6, the entire toner images accumulated on the belt 6 are subsequently transferred to a sheet of paper P by the second transferring unit 7.

The image forming system is designed in the present embodiment such that the image forming unit 3*a* contains transparent toners, the toner image of which is formed according to known image forming process steps at the location on the transfer belt 6, where succeeding color toner images are to be formed by respective image forming units 3*b* through 3*e*. That is, the image forming units 3*b*, 3*c*, 3*d* and 3*e* contain color toners of yellow, magenta, cyan and black, respectively, and color images of respective toners are successively formed on the transfer belt 6.

Although the amount of the transparent toner is determined so as to achieve sufficient image fixing efficiency and appropriate glossiness, which are in turn adjusted by the potential of the photosensitive member 1 and image patterns.

On the portion of the transfer belt 6 and in very front of the entrance of the second transferring unit 7, the image is therefore formed with toner layers of the colors of transparent T, yellow Y, magenta M, cyan C and black K in that order from the side of the belt 6.

Subsequently in the second transferring unit 7, the thus formed toner image on the transfer belt 6 is brought into contact under pressure with, and then transferred to, the copy sheet P. The image on the sheet P is obtained following the transfer with the order of the layers reversed, that is, the transparent toner layer as the uppermost.

Figure 3:
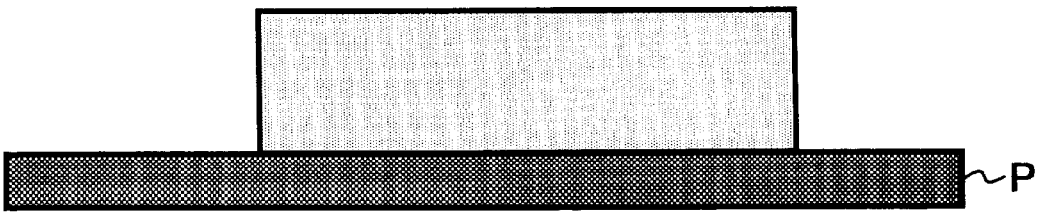
FIG. 3 is a section view illustrating the layer formed from the transparent and color toners of FIG. 2 following the heat fixing step.

The sheet P subsequently passes through the fixing unit 8, in which heated fusing steps are carried out under pressure for the toner image to be fixed as shown in FIG. 3.

The fixing unit 8 utilizes not only heated rolls, but may alternatively use non-contact means such as, for example, heated plates.

In addition to the aforementioned tandem type of image forming process incorporating the transfer belt, the present embodiment may also be adaptable to other processes such as a tandem type color process in which the images are transferred directly to a paper sheet, one drum color process, another color process in which toner images are overlaid on a photosensitive member.

It is noted herein with respect to the order of the layer accumulation. The order is not necessarily such that the transparent toner layer is uppermost on the sheet P, but other order of the layers may also be adopted.

EXAMPLE 1

The composition of transparent toner, and color particle, containing liquid developers utilized in the present embodiment will be described herein below.

With this composition it is intended that, even in case when silicone oil is used as the carriers, for which has high releasing characteristics are exhibited, the efficiency in fixing toner images is increased considerably through the formation of a film from transparent toners having a relatively large particle size and by covering color toner layers formed beforehand with the thus formed film.

| (1) Transparent toner containing developer | | |
|---|---|---|
| Carrier: | Dimethyl silicone oil 5~50 cSt (the unit 'cSt' stands for 'centi-Stokes' for the kinetic viscosity.) | 70%, |

The material for the carrier is not limited to the above noted silicone oil, but other electrically insulating solvents generally used as liquid developing agents such as, for example, isoparaffin related solvents may also be suitably used in the present embodiment.

| | | |
|---|---|---|
| Toner: | Average diameter of about 6 μm | 30% |
| Resin: | Denatured epoxy with Tg: 50~60° C. | |
| Others: | Anti-static and dispersing agents. | |
| | (2) Color particle containing developer | |
| Carrier: | Dimethyl silicone oil 5~500 cSt | 85% |
| Toner: | Average diameter of about 2 μm | 15% |
| Resin: | Denatured epoxy with Tg: 50~60° C. | |
| Pigment: | Phthalocyanine Blue, quinacridone, etc. | |
| Others: | Anti-static and dispersing agents. | |

Figure 4:
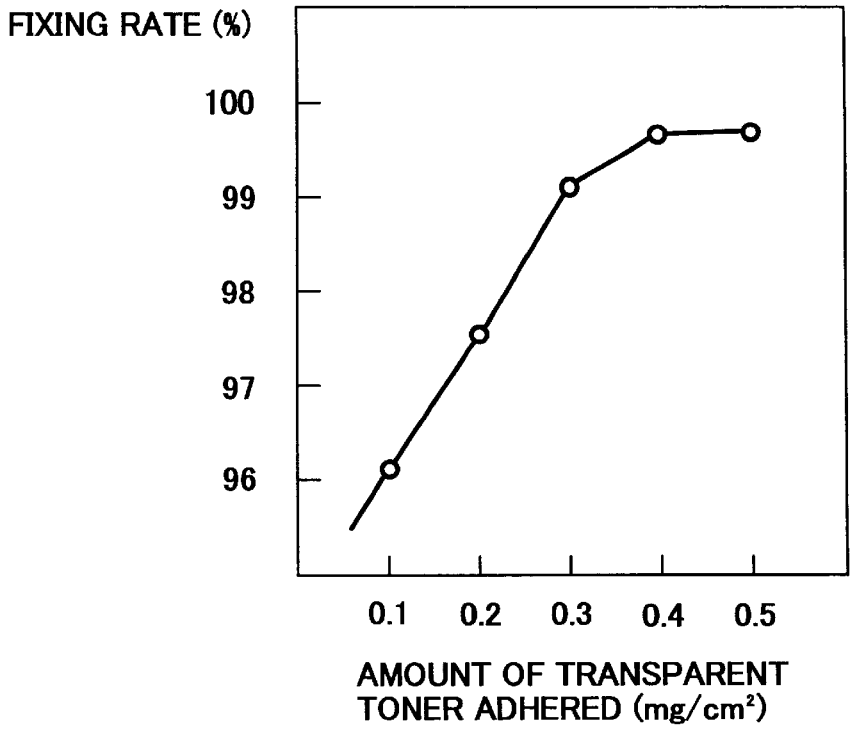
FIG. 4 plots fixing rates obtained from experimentation versus the amount of transparent toner adhered to the toner images.
Figure 5:
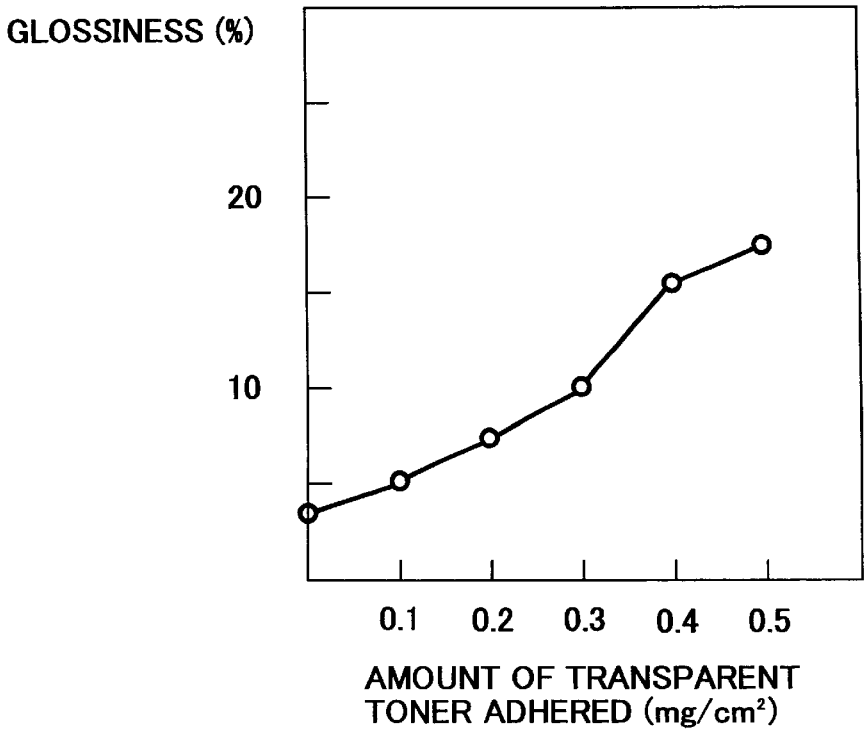
FIG. 5 plots glossiness values obtained from experimentation versus the amount of transparent toner adhered to the toner images.

Results from experimentation are shown in FIGS. 4 and 5 with respect to the image fixing characteristics when silicone oil was used as the carrier. For the fixing in the present embodiment a roller type fixing unit is used consisting of an iron heating roller surface coated with Teflon with a halogen heater housed therein and an opposing pressure roller of silicon rubber. The surface temperature of the heating roller was adjusted at 100° C. during the fixing steps.

FIG. 4 plots fixing ratios obtained from experimentation, vertically, versus the amount of transparent toner adhered to the toner images, horizontally.

The method of peering with an adhesive tape was used herein and the fixing rates were obtained as follows. After a transparent, adhesive tape is pressed with a sufficient pressure onto toner images previously fixed on a copy sheet, the tape was removed and then pressed onto a second sheet of paper. Subsequently, measurements were carried out to determine optical density values for two sets of the toner images, one transferred to the second sheet and the other remaining on the first copy sheet. The fixing rate was then obtained as the ratio of the latter optical density to the total density. Accordingly, the value of 100% is obtained for the complete fixing.

From the results shown in FIG. 4, it is indicated that the efficiency in fixing toner images or fixing rate is considerably improved by utilizing the transparent toners.

The glossiness change resulted from the transparent toner addition is shown in FIG. 5, which plots glossiness values obtained from the experimentation, vertically, versus the amount of transparent toner adhered, horizontally.

From the results shown in FIG. 5 it is indicated that the glossiness increases with the increase in the amount of transparent toner adhered. In addition, the results in FIG. 5 also indicate the trend of saturation of the glossiness with increasing the amount of transparent toner. This is considered to be closely related to the surface characteristics of the heating roller, which will be described later on.

Figure 6:
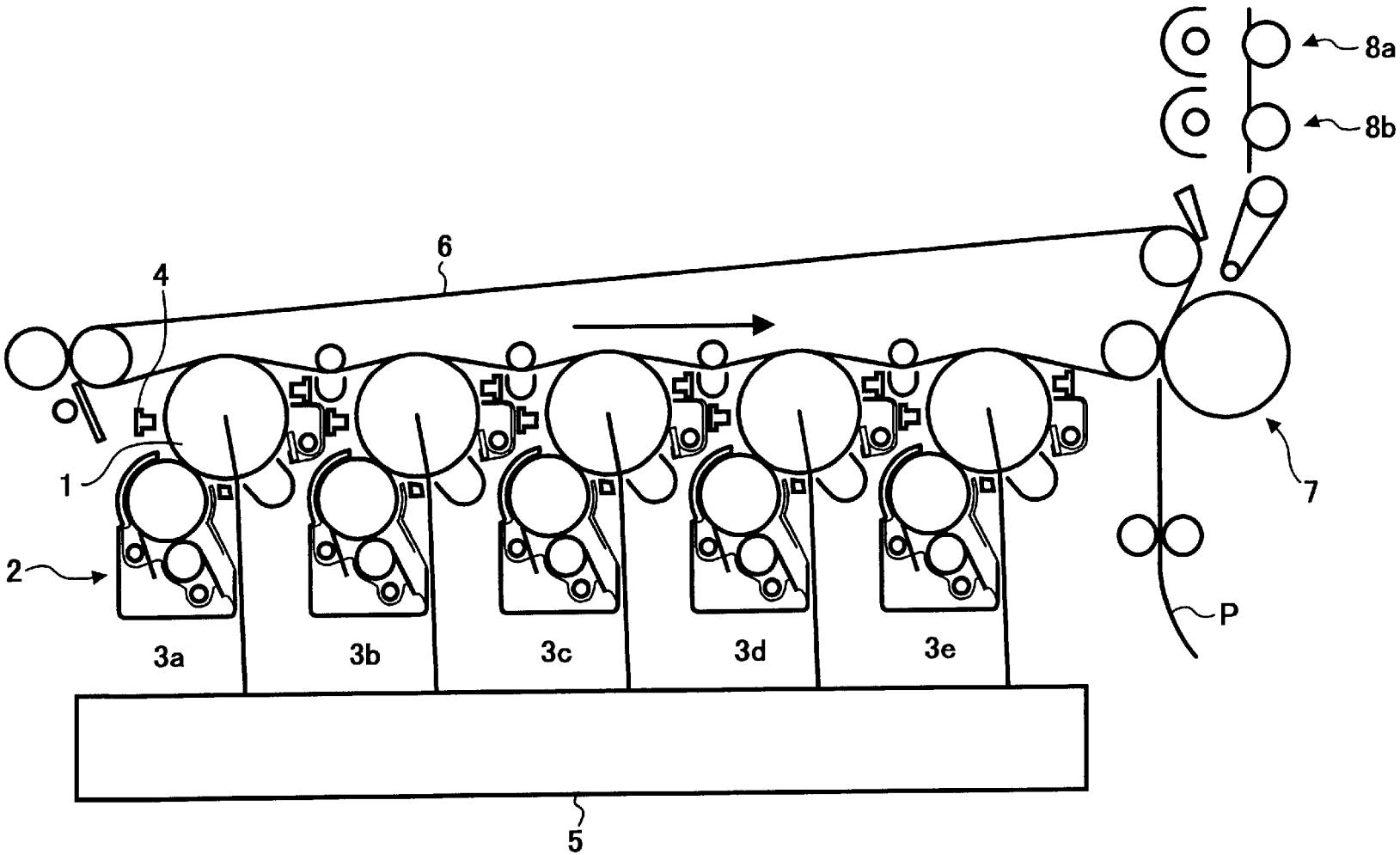
FIG. 6 is a section view of the color image forming system adapted to the tandem type process steps according to another embodiment disclosed herein.
Figure 7:
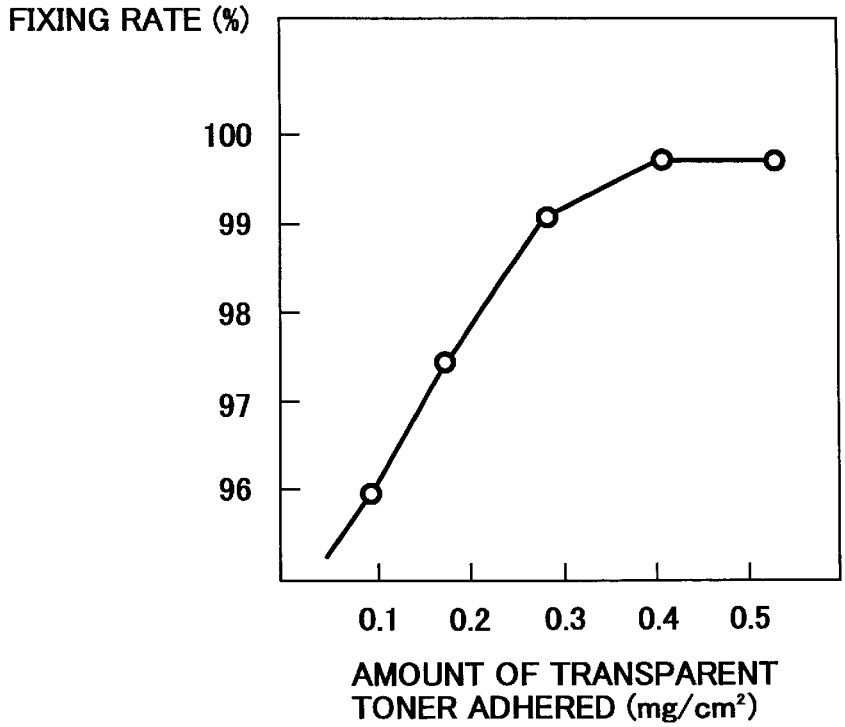
FIG. 7 plots fixing rates obtained from experimentation versus the amount of transparent toner adhered to the toner images according to another embodiment disclosed herein.
Figure 8:
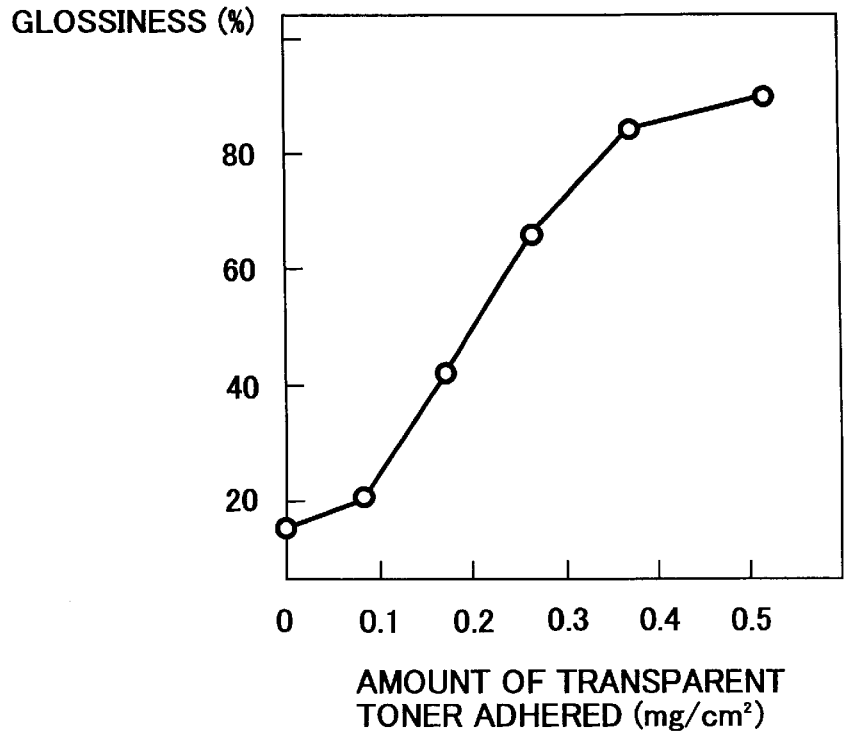
FIG. 8 plots glossiness values obtained from the experimentation versus the amount of transparent toner adhered to the toner images according to another embodiment disclosed herein.

In another embodiment, several liquid developers and liquid development process using such developers will be detailed in reference to FIGS. 6 through 8.

The image forming system in the present embodiment has the construction approximately similar to that illustrated in FIG. 1, with the exception that a UV (ultraviolet) irradiation fixing unit 8*a* is incorporated into the fixing unit in combination with an IR (infrared) heating unit 8*b*.

The toner image is again formed on a paper sheet P in such an order as a transparent toner layer as the uppermost, which is reversed from that on the transfer belt 6. The thus formed toner image is then fed to the UV irradiation fixing unit 8*a* to be image fixed in a similar manner to that shown in FIG. 3. During the fixing step, nonvolatile silicone oil component in both color toner and transparent toner containing developers is absorbed into the sheet P to subsequently be diffused and held thereinto.

In order to improve the efficiency in the diffusion and holding, the sheet P together with the toner is heated by the IR infrared heating unit 8*b* prior to UV irradiation, whereby the fixing efficiency and image quality can be improved.

In addition to the above mentioned tandem type image forming process incorporating the transfer belt, the toners and process steps disclosed in the present embodiment may also be adaptable to other processes such as a tandem type color process in which the images are transferred directly to a paper sheet, one drum color process, another color process in which toner images are overlaid on a photosensitive member.

The composition of transparent toner, and color particle, containing liquid developers utilized in the present embodiment will be described.

With the developer composition it is intended that, even in case when silicone oil is used as the carriers, for which high releasing properties are exhibited, the efficiency in fixing toner images is considerably increased by forming a film from transparent toners with a relatively large particle size and by covering color toners with the thus formed film.

In addition, it is also intended that, by using UV curing resin as the carrier and by forming a film from the carrier itself, the efficiency in fixing is much improved and image recording is achieved having excellent surface glossiness.

(1) Transparent Toner Containing Developer

Carrier. UV curing resin which consists of photopolymerizing monomers and prepolymers, and photopolymerization initiators.

The photopolymerizing monomers suitably used in the present disclosure include polyfunctional methacrylate-based monomers for their relatively high polymerization velocity. Illustrative examples of the monomer include but are not limited to diethlene glycol diacrylate (DEGDA) and neopentylglycol diacrylate (NPGDA).

The photopolymerizing prepolymers suitably used for the preparation include acrylaytes such as polyester, epoxy, urethane and polyole.

The photopolymerization initiators suitably used are appropriately selected from those conventionally available. Illustrative examples of the initiators include Darocure 1116 and 1173 sold by Merck, Irgacure 651 and 184 by Chiba-Geigy, Bicure by Stoufer Chemical, and others.

As solvents suitably used for the preparation, there may appropriately be selected non-aqueous electrically insulating solvents with kinetic viscosity ranging approximately from 5 to 500 cSt. Illustrative examples of the solvents include Isopar by Exxon and silicone oil.

Transparent toner: Average diameter ranging from 2 to 10 $\mu$m.

Resin: Denatured epoxy, polyester and aclyric resin.

The resultant resin is preferably formed such that the difference in refractive index is within approximately 0.2 from that of the carrier. This is intended to alleviate the loss of transparency of the toner layer formed, which otherwise exhibits a white or muddy appearance, as found by the experimentation by the present inventor. The loss of transparency can be appropriately prevented using the present resin, since the above-mentioned UV curing resinous materials generally have refractive indices ranging from 1.45 to 1.48.

Others: Anti-static and dispersing agents.

Illustrative examples of the anti-static agents include metallic soap containing zirconium, iron or zinc, and examples of the dispersing agents include polymeric materials having the segments soluble to the carrier such as acrylic silicone, silicone rubber or lauric methacrylayte.

| (2) Color particle containing developer | | |
|---|---|---|
| Carrier: | Dimethyl silicone oil 5~500 cSt | 85% |
| Toner: | Average diameter of about 2 $\mu$m | 15% |
| Resin: | Denatured epoxy with Tg: 50~60° C. | |
| Pigment: | Phthalocyanine Blue, quinacridone, etc. | |
| Others: | Anti-static and dispersing agents. | |

The composition of transparent toner, and color particle, containing liquid developers utilized in the present embodiment will be described herein below.

| (1) Transparent toner containing developer | |
|---|---|
| Carrier: | |
| Photopolymerizing monomer: | |
| trimethylolpropane triacrylate | 7 g |
| Photopolymerizing prepolymer: | |
| poly-ether urethane compound containing acrylic groups | 50 g |

-continued

| (1) Transparent toner containing developer | |
|---|---|
| Photopolymerization initiator: | |
| Irugacure 184 by Chiba-Geigy | 3 g |
| Solvent: dimethyl silicone oil | 30 g |

Transparent toner: Polymer of 15 parts of methyl methacrylate and 85 parts of 2-ethylhexyl methacrylate, prepared in 100 parts of dimethyl silicone. 80 g.

These carrier and transparent toner components are subsequently admixed with 0.5 g. of 2-ethylhexyl-Zr as anti-static agent and 5 g. of lauryl methacrylate as dispersing agent, and then subjected to mixing in a bowl mill, whereby the transparent toner containing developer was obtained.

| (2) Color particle containing developer | | |
|---|---|---|
| Carrier: | Dimethyl silicone oil 50 cSt | 85 g |
| Toner: | Average diameter of about 2 $\mu$m | |
| Resin: | Denatured epoxy with Tg: 50~60° C. | 8 g |
| Pigment: | Phthalacyanine Blue, quinacridane, etc | 2 g |

These carrier and toner components are subsequently admixed with 0.5 g. of 2-ethylhexyl-Zr as anti-static agent and 4.5 g. of lauryl methacrylate as dispersing agent, then subjected to mixing in a bowl mill, whereby the color particle containing developer was obtained.

Results from the experimentation are shown in FIGS. 7 and 8 with respect to the fixing characteristics using silicone oil as the carrier, in which fixing process steps were carried out in combination of heating with a halogen heater and irradiation with UV beams.

The fixing rates were measured in a similar manner to those for obtaining the FIG. 4 graphical plots. The results are shown in FIG. 7, indicating that the efficiency in fixing toner images is considerably improved by utilizing the transparent toners in the present example as well.

The glossiness change resulted from the addition of transparent toners was measured in a similar manner to that for obtaining the FIG. 5 plot. The results are shown in FIG. 8, indicating that the glossiness increases with the increase in the amount of transparent toners added.

In addition, it should be noted the magnitude of the glossiness values in FIG. 8 is considerably larger as a whole than that in FIG. 5. This is considered due to a relatively smooth surface formed through the UV irradiation using the UV curing resin (FIG. 8), which is in contrast to less smooth surface formed by roll fixing without the UV curing resin (FIG. 5).

It is apparent from the above description including the examples, the methods disclosed herein for forming electrophotographic color images have several advantages over similar methods previously known.

For example, by forming a layer of transparent toner on top of the plurality of underlying color toner layers, sufficient image fixing capability with appropriate glossiness can be achieved even with use as a carrier of silicone oil which has high releasing characteristics. That is, retaining essential features of the liquid development process such as high image qualities, for example, desired control of the level of image fixing and glossiness become feasible with the method and system disclosed herein.

Also in addition to the plurality of color particle containing liquid developers, by affixing transparent toner particle containing developer which is charged to the specific polarity onto the portions of the toner images on the photosensitive member prior to transferring the toner images, sufficient fixing efficiency and appropriate glossiness can be achieved even with use as a carrier of silicone oil which has high releasing characteristics.

Further, with the transparent layer which is formed of UV curing resin and transparent toner to cover the plurality of underlying color toner layers formed beforehand, glossiness values can be appropriately controlled by adjusting the amount of the adhered transparent toner and the use of a proper fixing roll, effectively alleviating the shortcomings previously encountered by the use as a carrier of silicone oil which has high releasing characteristics.

Obviously, additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Applications Nos. 2000-330895 and 2001-281194, filed with the Japanese Patent Office on Oct. 30, 2000 and Sep. 17, 2001, respectively, the entire contents of which are hereby incorporated herein by reference.

What is claimed is:

1. A method for forming electrophotographic images by forming toner images on an intermediate transfer member using a plurality of color particle containing liquid developers, and subsequently transferring the toner images to a recording medium, comprising:

affixing transparent toner particles containing developer at least onto portions of the intermediate transfer member on which toner images are subsequently formed prior to transfer of the toner images to the recording medium, wherein a content of solid components in the transparent toner containing developer is larger than that in the color particle containing developer.

2. The method according to claim 1, wherein the transparent toner has a particle size larger than that of the color particle.

3. A method for forming electrophotographic images by forming toner images on an intermediate transfer member using a plurality of color particle containing liquid developers, and subsequently transferring the toner images to a recording medium, the color particle being charged to a first polarity, comprising:

affixing, in addition to the plurality of color particle containing liquid developers, transparent toner particles containing developers at least onto portions of the intermediate transfer member on which toner images are subsequently formed prior to transferring the toner images to the recording medium, the transparent toner particle being charged to a second polarity that is either a same as, or opposite to, the first polarity, wherein a content of solid components in the transparent toner containing developer is larger than that in the color particle containing developer.

4. The method according to claim 3, wherein the liquid developers consist essentially of silicone oil composition as the carrier.

5. The method according to claim 4, wherein the silicone oil composition is nonvolatile at room temperature.

6. A method for forming electrophotographic images by forming toner images on an intermediate transfer member using a plurality of color particle containing liquid developers, and subsequently transferring the toner images to a recording medium, the color particle being charged to a first polarity, comprising:

affixing, in addition to the plurality of color particle containing liquid developers, transparent toner particles containing developers at least onto portions of the intermediate transfer member on which toner images are subsequently formed prior to transferring the toner images to the recording medium, the transparent toner particle being charged to a second polarity that is either a same as, or opposite to, the first polarity, wherein the transparent toner particle containing developer consists essentially of carriers which contain ultraviolet curing resin to be image fixed through ultraviolet beam irradiation.

7. The method according to claim 6, wherein a difference in refractive index of the resin in the transparent toner particle containing developer is within approximately 0.2 from that of the carriers.

8. The method according to claim 6, wherein the liquid developers consist essentially of silicone oil composition as the carrier.

9. The method according to claim 8, wherein the silicone oil composition is nonvolatile at room temperature.

10. A method for forming electrophotographic images by forming toner images on an intermediate transfer member using a plurality of color particle containing liquid developers, and subsequently transferring the toner images to a recording medium, the color particle being charged to a first polarity, comprising:

affixing, in addition to the plurality of color particle containing liquid developers, transparent toner particles containing developers at least onto portions of the intermediate transfer member on which toner images are subsequently formed prior to transferring the toner images to the recording medium, the transparent toner particle being charged to a second polarity that is either a same as, or opposite to, the first polarity; and non-contact heating the toner images prior to the image fixing through ultraviolet beam irradiation.

11. The method according to claim 10, wherein the liquid developers consist essentially of silicone oil composition as the carrier.

12. The method according to claim 11, wherein the silicone oil composition is nonvolatile at room temperature.

13. A system for forming electrophotographic images comprising:

an intermediate transfer member on which toner images are formed using a plurality of color particle containing liquid developers, and from which the toner images are subsequently transferred to a recording medium, wherein transparent toner particles containing developer are affixed at least onto portions of the intermediate transfer member on which toner images are subsequently formed prior to transfer of the toner images to the recording medium, wherein a content of solid components in the transparent toner containing developer is larger than that in the color particle containing developer.

14. The system according to claim 13, wherein the transparent toner has a particle size larger than that of the color particle.

15. A system for forming electrophotographic images comprising:

an intermediate transfer member on which toner images are formed using a plurality of color particle containing liquid developers, and from which the toner images are subsequently transferred to a recording medium, the color particle being charged to a first polarity, wherein in addition to the plurality of color particle containing liquid developers, transparent toner particles containing developers are affixed at least onto portions of the intermediate transfer member on which toner images are subsequently formed prior to transferring the toner images to the recording medium, the transparent toner particle being charged to a second polarity that is either a same as, or opposite to, the first polarity, wherein a content of solid components in the transparent toner containing developer is larger than that in the color particle containing developer.

16. The system according to claim 15, wherein the liquid developers consist essentially of silicone oil composition as the carrier.

17. The system according to claim 16, wherein the silicone oil composition is nonvolatile at room temperature.

18. A system for forming electrophotographic images comprising:

an intermediate transfer member on which toner images are formed using a plurality of color particle containing liquid developers, and from which the toner images are subsequently transferred to a recording medium, the color particle being charged to a first polarity, wherein in addition to the plurality of color particle containing liquid developers, transparent toner particles containing developers are affixed at least onto portions of the intermediate transfer member on which toner images are subsequently formed prior to transferring the toner images to the recording medium, the transparent toner particle being charged to a second polarity that is either a same as, or opposite to, the first polarity, wherein the transparent toner particle containing developer consists essentially of carriers which contain ultraviolet curing resin to be image fixed through ultraviolet beam irradiation.

19. The system according to claim 18, wherein a difference in refractive index of the resin in the transparent toner particle containing developer is within approximately 0.2 from that of the carriers.

20. The system according to claim 18, wherein the liquid developers consist essentially of silicone oil composition as the carrier.

21. The system according to claim 20, wherein the silicone oil composition is nonvolatile at room temperature.

22. A system for forming electrophotographic images comprising:

an intermediate transfer member on which toner images are formed using a plurality of color particle containing liquid developers, and from which the toner images are subsequently transferred to a recording medium, the color particle being charged to a first polarity, wherein in addition to the plurality of color particle containing liquid developers, transparent toner particles containing developers are affixed at least onto portions of the intermediate transfer member on which toner images are subsequently formed prior to transferring the toner images to the recording medium, the transparent toner particle being charged to a second polarity that is either a same as, or opposite to, the first polarity, wherein the toner images are non-contact heated prior to the image fixing through ultraviolet beam irradiation.

23. The system according to claim 22, wherein the liquid developers consist essentially of silicone oil composition as the carrier.

24. The system according to claim 23, wherein the silicone oil composition is nonvolatile at room temperature.

* * * * *